US007121454B2

(12) United States Patent
Sugahara et al.

(10) Patent No.: US 7,121,454 B2
(45) Date of Patent: Oct. 17, 2006

(54) MOVING-FILM DISPLAY DEVICE

(75) Inventors: Atsushi Sugahara, Kawasaki (JP); Yuko Kizu, Yokohama (JP); Kenichi Mori, Yokohama (JP); Isao Amemiya, Machida (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 512 days.

(21) Appl. No.: 10/734,299

(22) Filed: Dec. 15, 2003

(65) Prior Publication Data

US 2005/0073514 A1 Apr. 7, 2005

(30) Foreign Application Priority Data

Dec. 25, 2002 (JP) ..... 2002-373562

(51) Int. Cl.
*G09G 3/34* (2006.01)

(52) U.S. Cl. ..... 234/85; 345/109

(58) Field of Classification Search ..... 345/84, 345/85, 108, 109, 204
See application file for complete search history.

(56) References Cited

U.S. PATENT DOCUMENTS 4,564,836 A * 1/1986 Vuilleumier et al. ..... 345/85
4,740,785 A * 4/1988 Stroomer et al. ..... 345/85
4,891,635 A * 1/1990 Hata ..... 345/85
5,943,033 A 8/1999 Sugahara et al.
6,130,656 A 10/2000 Sugahara
6,239,777 B1 5/2001 Sugahara et al.
6,618,034 B1 9/2003 Sugahara et al.
2001/0054987 A1* 12/2001 Lang et al. ..... 345/4

* cited by examiner

*Primary Examiner*—Ricardo Osorio
(74) *Attorney, Agent, or Firm*—Oblon, Spivak, McClelland, Maier & Neustadt, P.C.

(57) ABSTRACT

A moving-film display device includes a moving-film having fixed and movable ends, and a stationary body having a counter face that is shaped more distant from the moving-film as a position of the counter face shifts from the fixed end side to the movable end side. A colored portion is disposed at the movable end of the moving-film. An auxiliary electrode is disposed on the moving-film between the fixed end and the movable end. A scanning electrode and holding electrode are disposed on the counter face to face the auxiliary electrode on the fixed end side and movable end side, respectively. A signal line is electrically connected to the holding electrode to supply an image signal. A drive section is configured to control voltages to be supplied to the auxiliary electrode, the scanning electrode, and the holding electrode.

20 Claims, 9 Drawing Sheets

FIG. 14A
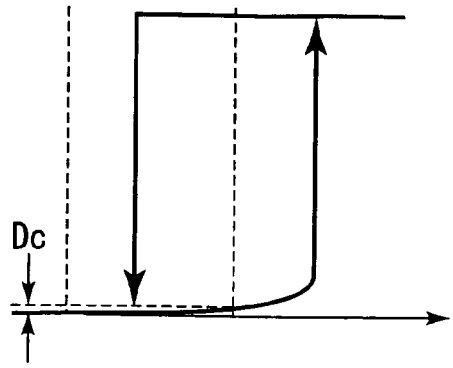
FIG. 14B
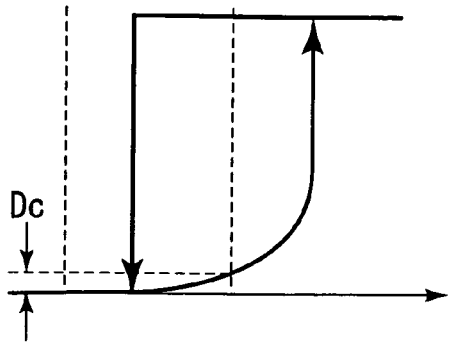
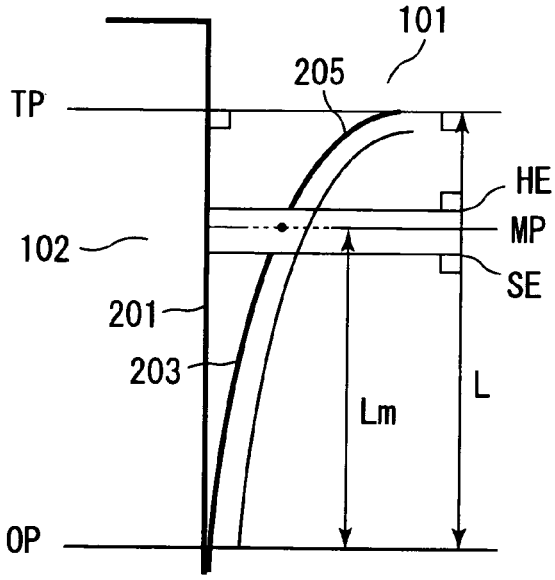
FIG. 15
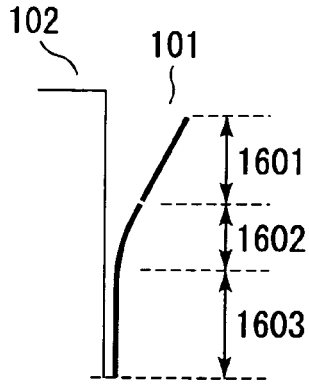
FIG. 16
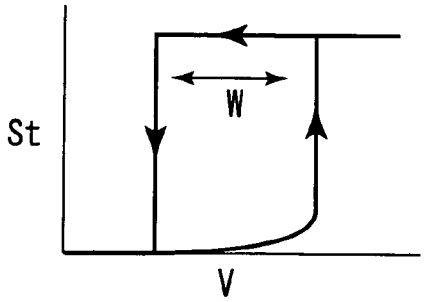
FIG. 17A
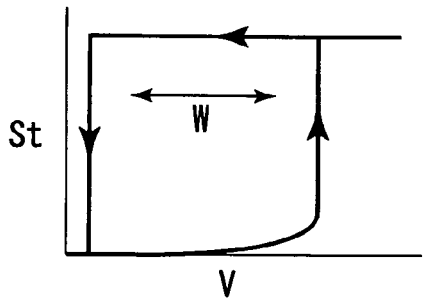
FIG. 17B

MOVING-FILM DISPLAY DEVICE

CROSS-REFERENCE TO RELATED APPLICATIONS

This application is based upon and claims the benefit of priority from the prior Japanese Patent Applications No. 2002-373562, filed Dec. 25, 2002, the entire contents of which are incorporated herein by reference.

BACKGROUND OF THE INVENTION

1. Field of the Invention

The present invention relates to a moving-film display device and driving method thereof.

2. Description of the Related Art

A moving-film display device has pixels, each of which is provided with a moving electrode disposed on a resilient moving-film and a stationary electrode disposed on a stationary body. The moving-film is controlled to deflect or not by the electrostatic force generated between the moving electrode and stationary electrode, so as to display image information. For example, the stationary body has a counter face with a curved surface facing the moving-film so that the moving-film can easily deflect (for example, Jpn. Pat. Appln. KOKAI Publication No. 2002-287040 (pages 3 to 5, and FIG. 1)).

As a device structure of such a moving-film display device, there is a structure in which two stationary electrodes are disposed one on either side of a moving-film, and holding electrodes are disposed near a display portion (colored portion) formed at the movable end of the moving-film (for example, Jpn. Pat. Appln. KOKAI Publication No. 8-271933 (pages 5 to 8, and FIG. 16)). As another device structure, there is a structure in which a plurality of stationary electrodes are disposed on a stationary body, and are supplied with different voltages (for example, Jpn. Pat. Appln. KOKAI Publication No. 2001-100121 (pages 4 to 7, and FIG. 10)).

However, according to these conventional moving-film display devices, cross talk of image information may occur when the image information is held. Furthermore, the threshold voltage for the moving-films to deflect may differ for each pixel, in relation to voltage applied to the moving-films or stationary bodies. This is due mainly to variation in internal stress of the moving-films, which is caused in their manufacturing process, and variation in clearance between each moving-film and stationary body, which is caused in attaching the moving-films to the stationary bodies. As a consequence, the conventional moving-film display devices are accompanied with a problem in that the image quality lowers.

BRIEF SUMMARY OF THE INVENTION

According to a first aspect of the present invention, there is provided a moving-film display device comprising:

a moving-film having a fixed end and a movable end;

a stationary body having a counter face that is shaped more distant from the moving-film as a position of the counter face shifts from the fixed end side to the movable end side;

a colored portion disposed at the movable end of the moving-film;

an auxiliary electrode disposed on the moving-film between the fixed end and the movable end, a scanning electrode disposed on the counter face to face the auxiliary electrode on the fixed end side;

a holding electrode disposed on the counter face to face the auxiliary electrode on the movable end side;

a signal line electrically connected to the holding electrode to supply an image signal; and a drive section configured to control voltages to be supplied to the auxiliary electrode, the scanning electrode, and the holding electrode.

According to a second aspect of the present invention, there is provided a driving method of the device according to the first aspect:

a writing first period in which a first potential difference is formed between the auxiliary electrode and the scanning electrode to cause the moving-film to deflect;

a writing second period in which the first potential difference is removed between the auxiliary electrode and the scanning electrode, while the holding electrode is supplied with a potential by the image signal, that determines the moving-film to maintain a deflecting state or not; and a retention period in which a state is maintained where the first potential difference is not formed between the auxiliary electrode and the scanning electrode, and a potential difference formed between the auxiliary electrode and the holding electrode falls in a range that holds a state given in the writing second period.

According to a third aspect of the present invention, there is provided a moving-film display device having a display area formed of a pixel matrix, which is defined by rows and columns of pixels, the device comprising:

a cantilever disposed in each pixel and having a fixed end and a free end to be movable by deflection, such that displayed color of each pixel is determined by an exposed state of the free end relative to the display area in accordance with deflection of the cantilever;

a first electrode disposed on the cantilever between the fixed end and the free end;

a second electrode disposed stationary to face the first electrode on the fixed end side;

a third electrode disposed stationary to face the first electrode on the free end side, distance between the first and third electrodes being larger than distance between the first and second electrodes;

a plurality of first scanning lines extending in the pixel matrix and each being configured to supply the first electrode with a first scanning signal for selecting each pixel;

a plurality of second scanning lines extending in the pixel matrix and each being configured to supply the second electrode with a second scanning signal for selecting each pixel;

a plurality of signal lines extending in the pixel matrix and each being configured to supply the third electrode with an image signal for determining displayed color of each pixel; and a drive and control section configured to selectively supply the first and second scanning lines and the signal lines with the first and second scanning signals and the image signal, respectively.

BRIEF DESCRIPTION OF THE SEVERAL VIEWS OF THE DRAWING

FIGS. 14A and 14B are views showing hysteresis characteristics under an ideal condition and a non-ideal condition, respectively, in relation to coupling deflection of a moving-film;

FIG. 15 is a view for explaining a moving-film display device according to a second embodiment of the present invention;

FIG. 16 is a view for explaining a moving-film display device according to a third embodiment of the present invention; and FIGS. 17A and 17B are views showing the relationship of distal end displacement St of a moving-film relative to applied voltage V between the moving-film and stationary body, to explain a hysteresis characteristic according to the third embodiment.

DETAILED DESCRIPTION OF THE INVENTION

Figure 1:
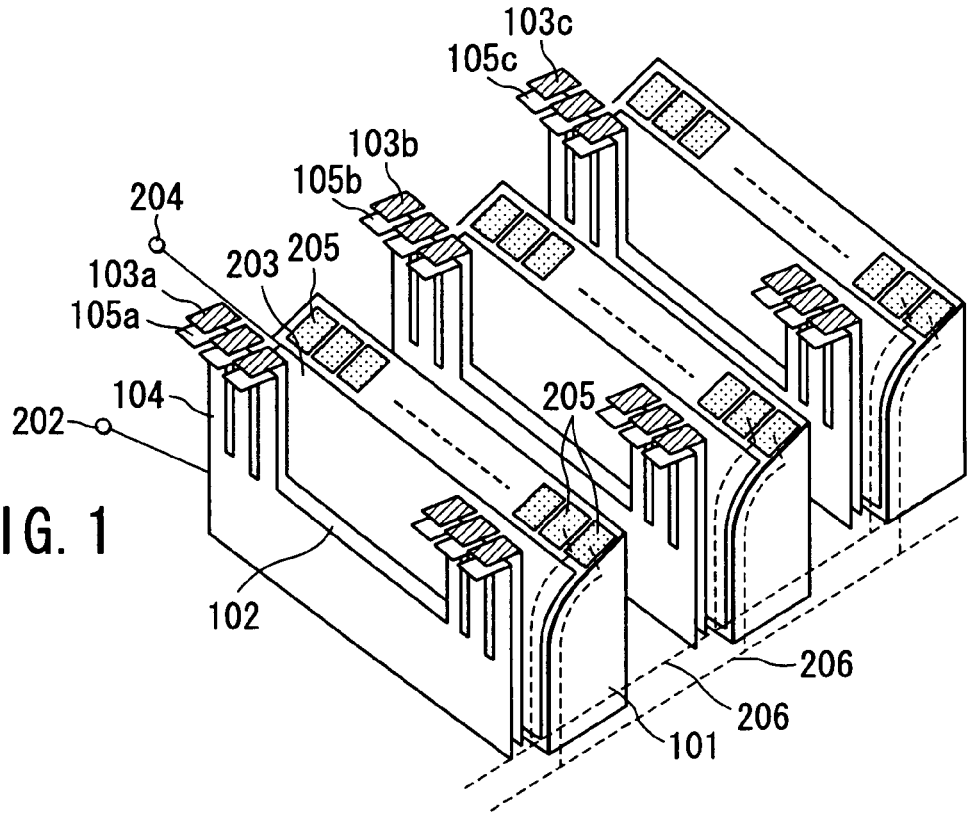
FIG. 1 is a perspective view showing a moving-film display device according to a first embodiment of the present invention.

Embodiments of the present invention will now be described with reference to the accompanying drawings. In the following description, the constituent elements having substantially the same function and arrangement are denoted by the same reference numerals, and a repetitive description will be given only when necessary.

First Embodiment

Figure 2:
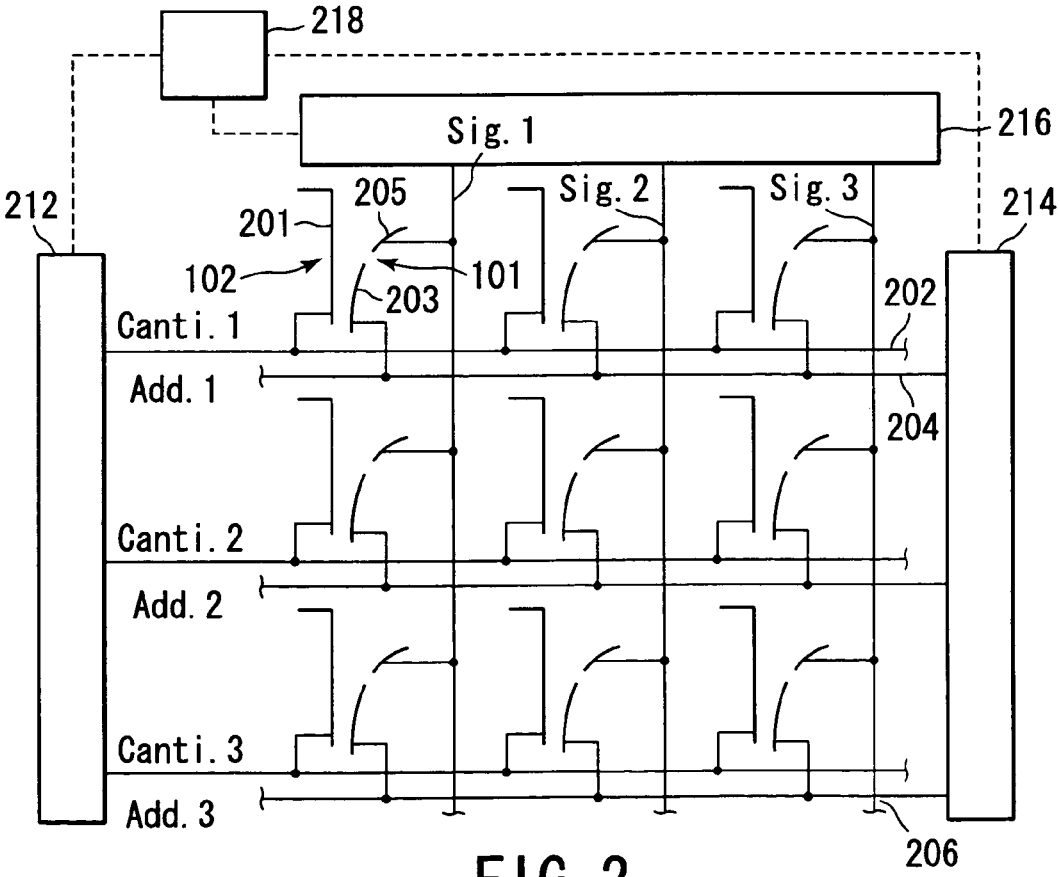
FIG. 2 is a circuit diagram showing the moving-film display device according to the first embodiment of the present invention.

FIGS. 1 and 2 are a perspective view and circuit diagram, respectively, showing a moving-film display device according to a first embodiment of the present invention. As shown in FIG. 1, the moving-film display device according to this embodiment includes fixed stationary bodies 101, and moving-films (cantilevers) 102 respectively disposed opposite the stationary bodies 101. Although FIG. 1 shows only three stationary bodies 101, a number of stationary bodies are used to dispose pixels in a two-dimensional matrix format, in reality.

The moving-films 102 are arranged such that pixels on one row share one integral moving-film. Each of the moving-films 102 is divided into strips on the distal end side, so as to provide a plurality of movable ends (free ends) that can move for respective pixels. Each of the distal ends of the movable ends is bent and used as a first color film (colored portion) 103*a*, 103*b*, 103*c*, or the like. In addition, as shown in FIG. 2, an auxiliary electrode 201 (not show in FIG. 1) is integratedly disposed on each moving-film 102 for pixels on one row. The auxiliary electrode 201 of pixels on one row is connected to one common auxiliary scanning line 202. The auxiliary electrode 201 is covered and isolated by an insulating film or the like (not shown).

A fixed film 104 is disposed to overlap each moving-film 102 with an insulating film interposed is there between. The fixed film 104 has a shape almost the same as the moving-film 102, but whose distal end on the movable end side is also fixed and thus stationary. The distal end of the fixed film 104 on the movable end side is divided into a plurality of portions, each of which is used as a second color film 105*a*, 105*b*, 105*c*, or the like. The first color film 103 and second color film 105 have different colors, such as black and white.

Pixels on one row share one integral stationary body 101, and stationary bodies 101 for the number of rows are two-dimensionally arrayed. The stationary bodies 101 are disposed in parallel with the moving-films 102. The counter face of each stationary body 101, which faces the corresponding moving-film 102 on the same row, has a curved surface. The counter face is shaped to be gradually more distant from the moving-film, as its position shifts from the fixed end side toward the movable end side. A scanning electrode 203 is integratedly disposed on the surface of each stationary body 101 for pixels on one row. The scanning electrode 203 of pixels on one row is connected to one common scanning line 204. The auxiliary electrode 201 and scanning electrode 203, i.e., the auxiliary scanning line 202 and scanning line 204 extend in parallel with each other.

Holding electrodes 205 are disposed for respective pixels, on a surface of each stationary body 101 closer to the movable end side than the scanning electrode 203 is. The holding electrodes 205 of pixels on one column are connected to one common signal line 206. In FIG. 1, for the sake of simplicity, only two signal lines 206 of two columns disposed on one end side are shown with broken lines. The signal lines 206 are electrically isolated from the auxiliary scanning lines 202 and scanning lines 204, and extend across them three-dimensionally. This simple structure allows the device to operate in accordance with simple matrix drive.

In other words, as shown in FIG. 2, a moving-film display device according to this embodiment has a display area formed of a pixel matrix defined by rows and columns of pixels. The color of each pixel to be displayed is determined by change in exposed state of the movable end (free end) of the moving-film 102 relative to the display area, in accordance with deflection movement of the moving-film (cantilever) 102.

According to the basic concept, each pixel has a combination of one moving-film (cantilever) 102, one fixed film 104, and one stationary body 101. Furthermore, each pixel has a combination of one auxiliary electrode 201, one scanning electrode 203, and one holding electrodes 205. The auxiliary electrodes 201 of pixels on the same row in the pixel matrix are commonly connected to one auxiliary scanning line 202. Similarly, the scanning electrodes 203 of pixels on the same row are commonly connected to one scanning line 204. On the other hand, the holding electrodes 205 of pixels on the same column are commonly connected to one signal line 206.

The auxiliary scanning lines 202, scanning lines 204, and signal lines 206 are connected to an auxiliary scanning line driver 212, scanning line driver 214, and signal line driver 216, respectively. The auxiliary scanning line driver 212 and scanning line driver 214 selectively supply the auxiliary scanning lines 202 and scanning lines 204 with first and second scanning signals, respectively, for selecting the pixels. On the other hand, the signal line driver 216 selectively supplies the signal lines 206 with an image signal for determining color to be displayed by the pixels. A controller 218 is used to control the drivers 212, 214, and 216.

Figure 3:
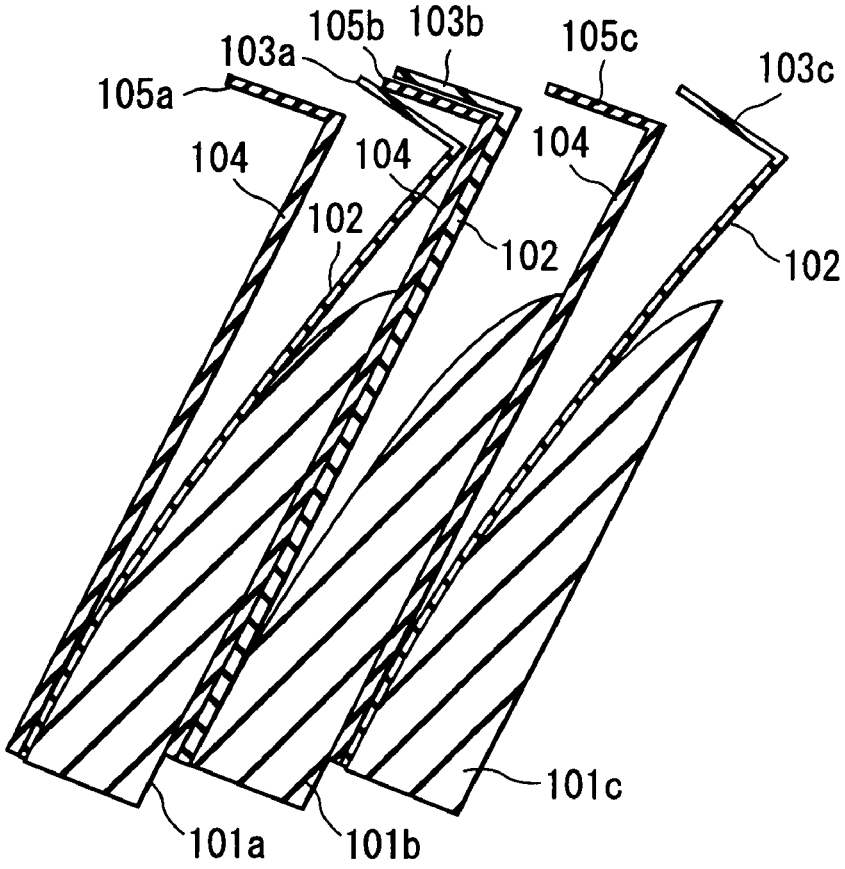
FIG. 3 is a sectional view for explaining the mechanism of display in a moving-film display device.

FIG. 3 is a sectional view for explaining the mechanism of display in a moving-film display device. FIG. 3 shows a state where a potential difference is formed between the stationary body 101 and moving-film 102, thereby causing electrostatic attraction to work thereon. At this time, the moving-film 102 deflects, and the first color film 103*a* moves from a position above the second color film 105*b* to a position below the adjacent second color film 105*b*, whereby the color of the second color film 105*a* is exposed. On the other hand, in reverse, when the moving-film 102 does not deflect, the first color film 103*a* covers the second color film 105*b*, whereby the color of the first color film 103*b* is exposed.

The fixed film 104 may be removed, while providing the stationary body 101 with a color different from the first color film 103. In this case, the color of the first color film 103*b* is exposed when the moving-film 102 does not deflect, and the color of the stationary body 101 is exposed when the moving-film 102 deflects.

Figure 4:
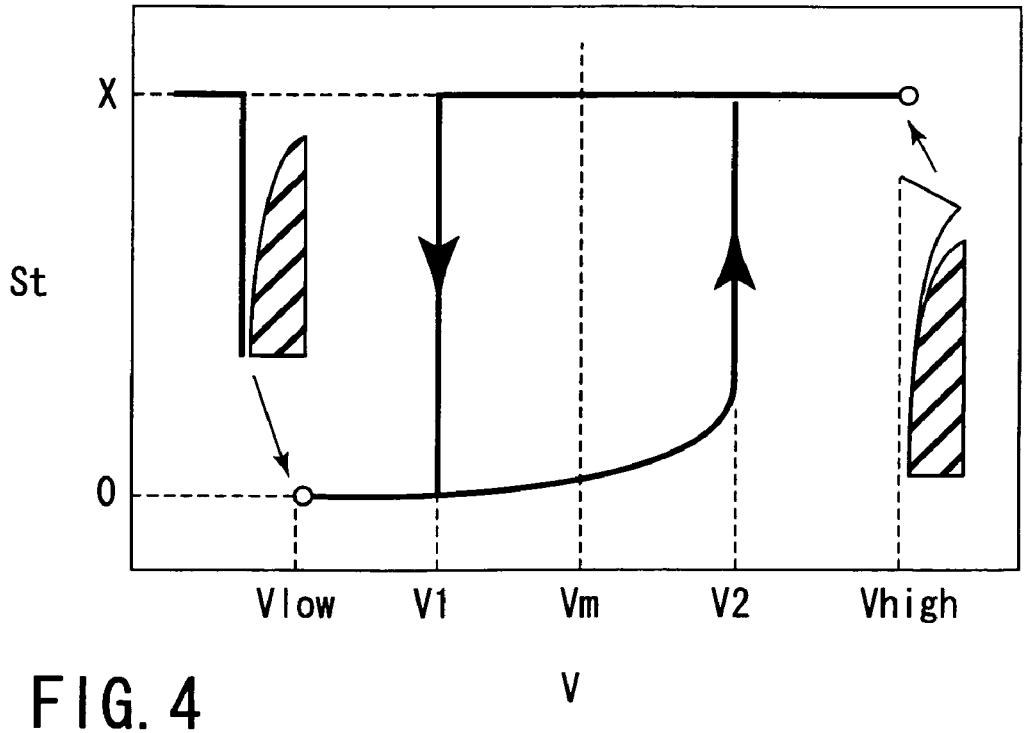
FIG. 4 is a view showing the relationship of distal end displacement St of the moving-film relative to applied voltage V between the moving-film and stationary body, to explain a hysteresis characteristic.

FIG. 4 is a view showing the relationship of distal end displacement St of the moving-film relative to applied voltage V between the moving-film and stationary body, to explain a hysteresis characteristic. When voltage is increasingly applied between the auxiliary electrode and scanning electrode to generate a potential difference between the moving-film and stationary body, the relationship of the distal end displacement St of the moving-film relative to the applied voltage is as follows. Specifically, with a gradual increase in the applied voltage, the distal end displacement gradually increases for a while. Then, when the applied voltage takes on V2, the moving-film deflects abruptly and the displacement (deflection amount) becomes X. Thereafter, in reverse, with a gradual decrease in the applied voltage, the displacement is kept at X for a while. Then, when the applied voltage takes on V1, the moving-film moves abruptly and the displacement becomes zero. Accordingly, the moving-film has a hysteresis characteristic with such threshold voltages. The threshold voltage V2 for abrupt deflection is larger than the threshold voltage V1 for abrupt return from the deflection.

Figure 5:
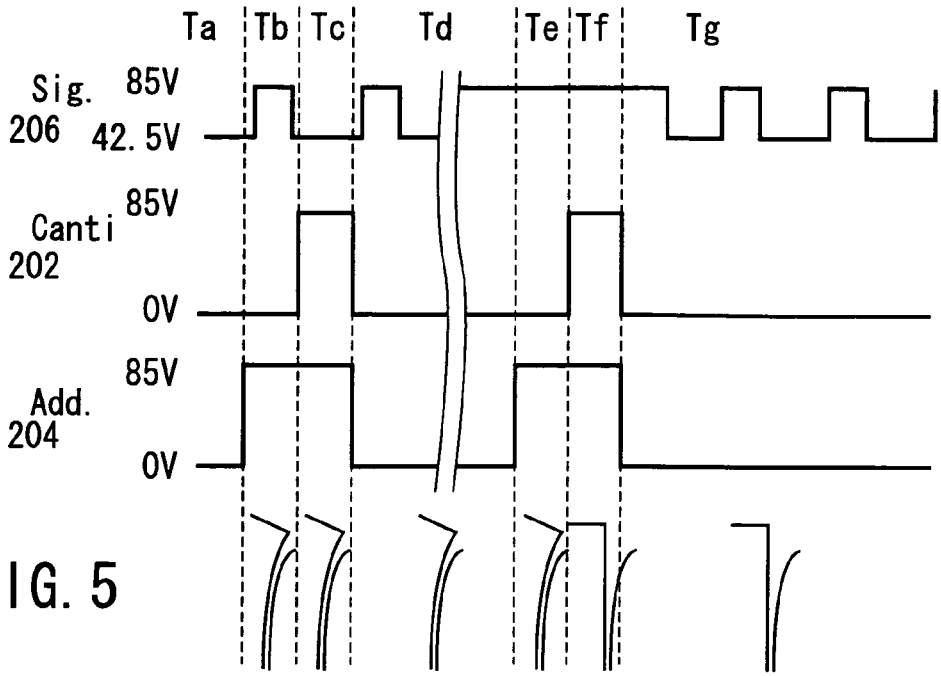
FIG. 5 is a view showing a drive sequence in the moving-film display device according to the first embodiment of the present invention.

FIG. 5 is a view showing a drive sequence in the moving-film display device according to the first embodiment of the present invention. In FIG. 5, Ta, Td, and Tg denote a retention period, Tb and Te denote a white writing period (writing first period), and Tc and Tf denote a release period (writing second period). Although the writing first period is used as a white writing period in this embodiment, this period may be used to write a color other than white.

First, in the white writing period (Tb or Te ), the auxiliary scanning line 202 (Canti) is set at 0V (lower potential), and the scanning line 204 (Add.) is set at 85V (higher potential). At this time, the signal line 206 (Sig.) is set at 42.5V (lower potential) or 85V (higher potential), depending on the image information. In the white writing period (Tb or Te ), the moving-film deflects toward the stationary body due to a potential difference of 85V between the auxiliary scanning line 202 and scanning line 204, i.e., between the auxiliary electrode and scanning electrode, even while the signal line 206 is at either potential.

Then, in the release period (Tc or Tf ), the auxiliary scanning line 202 is changed to 85V (higher potential), while the scanning line 204 is kept at 85V. At this time, if the signal line 206 is set at 85V (period Tf), the auxiliary scanning line 202, scanning line 204, and signal line 206, i.e., the auxiliary electrode, scanning electrode, and holding electrode have the same potential. As a consequence, the moving-film separates from the stationary body and returns to the original state, i.e., non-deflecting state. On the other hand, at this time, if the signal line 206 is set at 42.5V (period Tc), although the auxiliary scanning line 202 and scanning line 204 have the same potential, the auxiliary scanning line 202 and signal line 206, i.e., the auxiliary electrode and holding electrode have a potential difference therebetween. As a consequence, the moving-film remains deflecting toward the stationary body.

Then, in the retention period (Ta, Td, or Tg), the auxiliary scanning line 202 is changed to 0V, and the scanning line 204 is also changed to 0V (lower potential). The signal line 206 is used to apply image information to pixels connected to other scanning lines 204, and thus the potential of the signal line 206 is varying between its lower potential and higher potential. Accordingly, in the retention period (Ta, Td, or Tg), a potential difference of 42.5V or 85V is formed between the auxiliary scanning line 202 and signal line 206, i.e., between the auxiliary electrode and holding electrode. However, the counter face of the stationary body has a curved surface that becomes gradually more distant from the moving-film, as its position shifts from the fixed end side toward the movable end side of the moving-film. As a consequence, the moving-film can essentially maintain a state given in the release period, without reference to the potential difference of 42.5V or 85V formed between the auxiliary electrode and holding electrode in the retention period.

For example, the release period (Tf) renders a state where the moving-film is separated from the stationary body, and then shifts to the following retention period (Tg), along with this state, i.e., where the auxiliary electrode is largely separated from the holding electrode. As the distance between the auxiliary electrode and holding electrode is larger, a relatively smaller attraction is-generated between the auxiliary electrode and holding electrode by the potential difference of 42.5V or 85V formed between the auxiliary electrode and holding electrode in the retention period. As a consequence, in the retention period (Tg), the moving-film does not substantially deflect by the attraction toward the stationary body, but essentially maintains the non-deflecting state given in the release period (Tf).

On the other hand, the release period (Tc) renders a state where the moving-film deflects toward the stationary body, and then shifts to the following retention period (Td), along with this state, i.e., where the auxiliary electrode is very close to the holding electrode. As the distance between the auxiliary electrode and holding electrode is smaller, a relatively larger attraction is generated between the auxiliary electrode and holding electrode by the potential difference of 42.5V or 85V formed between the auxiliary electrode and holding electrode in the retention period. As a consequence, in the retention period (Td), the moving-film remains deflecting by the attraction toward the stationary body, and thus essentially maintains the deflecting state given in the release period (Tc).

As a consequence, the apparatus according to this embodiment allows a state given in the release period to be stably maintained in the retention period, in either case where the moving-film 102 deflects or not. The holding electrode 205 is disposed at a position where it can effectively apply electrostatic attraction to the moving-film 102 only when the moving-film 102 deflects, i.e., a position that corresponds to the movable end side of the moving-film 102 when the moving-film 102 deflects. This arrangement allows the moving-film 102 to be easily held in either deflecting state or non-deflecting state, thereby preventing cross talk from occurring, to improve image quality even in simple matrix drive.

The apparatus according to this embodiment employs simple matrix drive. This arrangement realizes selection and writing of pixels only by connecting the signal lines 206, scanning lines 204, and auxiliary scanning lines 206 to drivers, such as the signal line driver 216, scanning line driver 214, and auxiliary scanning line driver 216. In this case, the pixels require no switching elements, thereby simplifying the device structure.

In the example shown in FIG. 5, each of the auxiliary scanning line and scanning line is set at potentials of 0V and 85V, while the signal line is set at potentials of 42.5V and 85V. These potentials may be changed in accordance with the size, material, thickness, or the like of the moving-film 102 or stationary body. For returning the moving-film 102 to the original non-deflecting state after the period Tf shown in FIG. 5, i.e., where the moving-film 102 deflects, it is desirable to equalize all the potentials of the auxiliary scanning line 202, scanning line 204, and signal line 206. With this operation, the moving-film 102 can readily return from the deflecting state to the original non-deflecting state, thereby reliably preventing image display errors.

In the retention period (Td or Tg) shown in FIG. 5, the moving-film 102 maintains the deflecting state only by electrostatic attraction between the auxiliary electrode 201 (almost all over the moving-film 102) and the holding electrodes 205 (partly over the stationary body 101). On the other hand, the relationship between the applied voltage and distal end displacement shown in FIG. 4 stands for a case where electrodes are respectively disposed almost all over the moving-film 102 and almost all over the stationary body 101, and electrostatic attraction is generated between them. Thus, the retention state shown in FIG. 5 differs from the retention state shown in FIG. 4. The holding electrode 205 is disposed far from the moving-film 102 (in the non-deflecting state). Accordingly, if the applied voltage decreases in the retention state shown in FIG. 5 where the moving-film 102 deflects, the moving-film 102 separates from the stationary body and returns to the non-deflecting state, when the applied voltage crosses V1.

Figure 6:
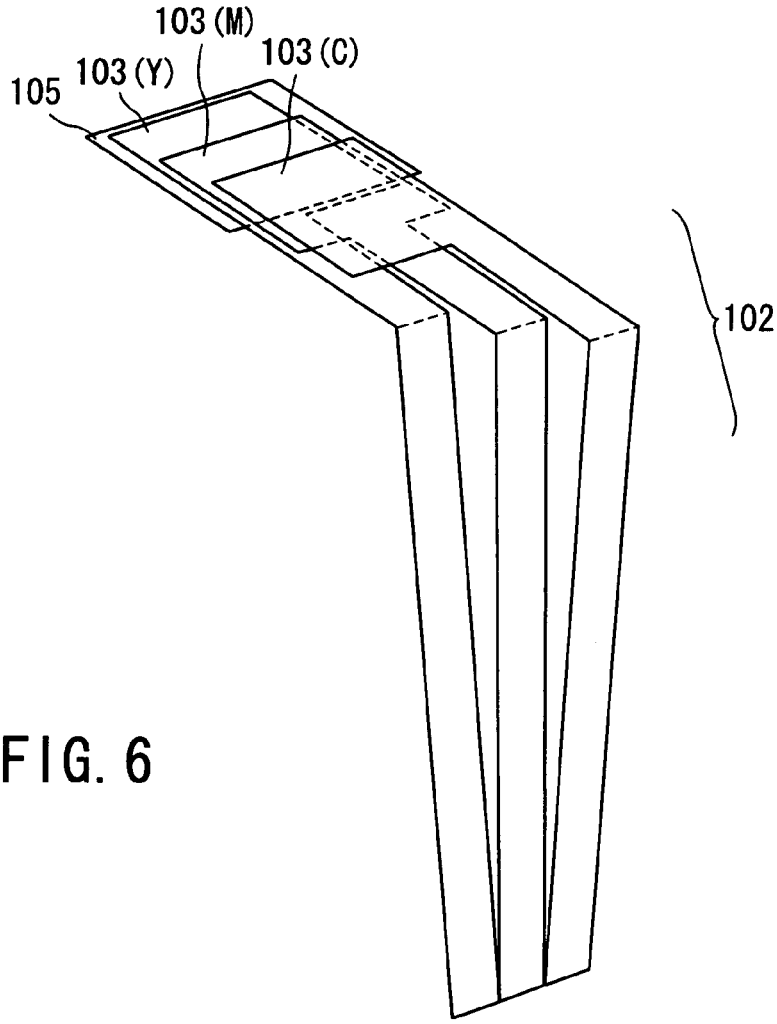
FIG. 6 is a view schematically showing one pixel of a moving-film display device of a color display type.

This embodiment may be applied to a moving-film display device for displaying color images. FIG. 6 is a view schematically showing one pixel of a moving-film display device of a color display type. In the case of color display, for example, three first color films 103(C), 103(M), and 103(Y) are stacked above one second color film 105 of, e.g., white. The three first color films are formed of a transparent material colored with Cyan 103(C), Magenta 103(M), and Yellow 103(Y). The three first color films 103(C), 103(M), and 103(Y) are attached to respective moving-films 102 that do not overlap each other, so that the three first color films can be put above the second color film 105 independently of each other.

Next, an explanation will be given of a method of manufacturing a moving-film display device according to this embodiment.

Figure 7:
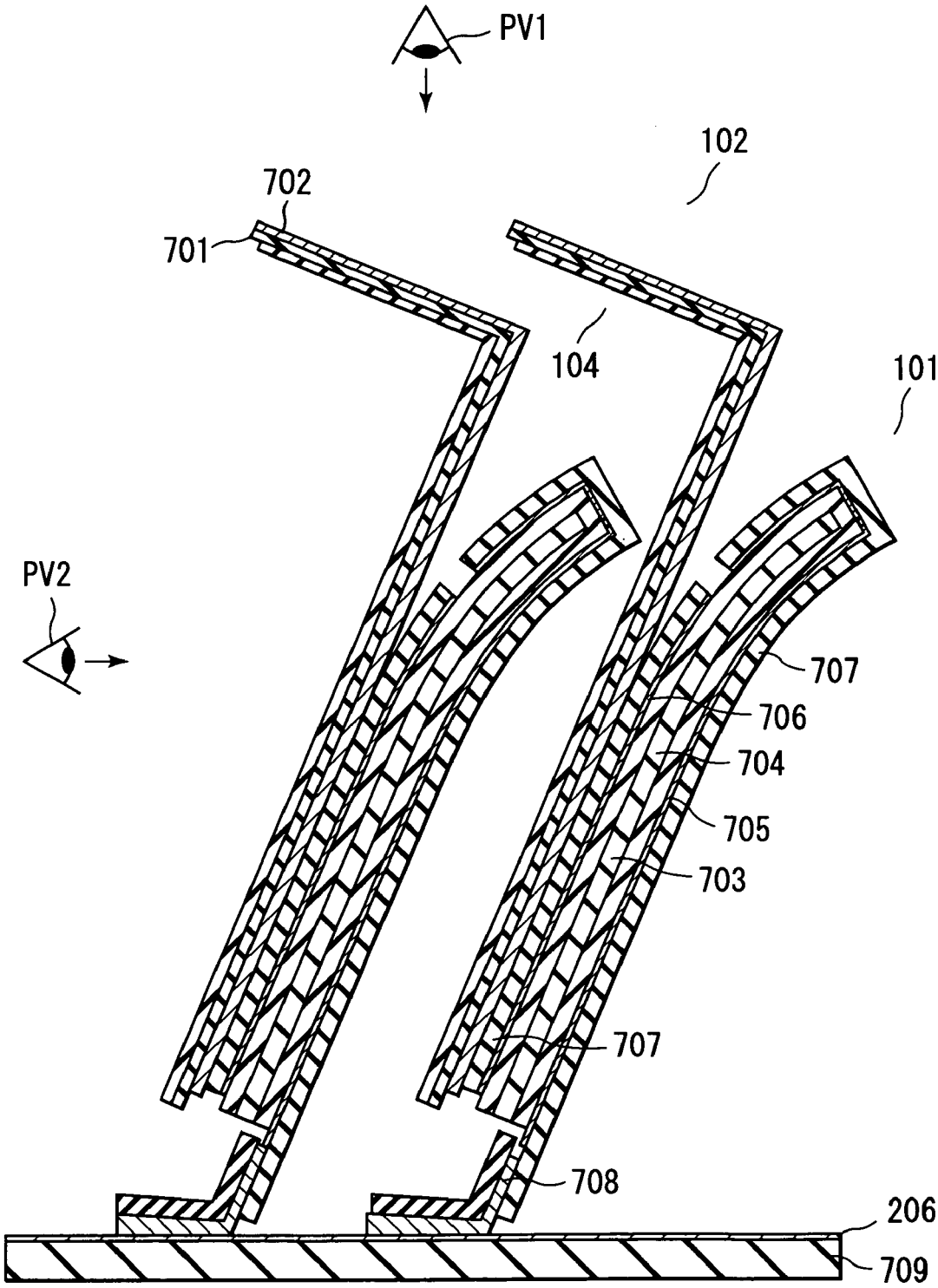
FIG. 7 is a sectional view showing the pixel structure of a moving-film display device according to the first embodiment of the present invention.

FIG. 7 is a sectional view showing the pixel structure of a moving-film display device according to the first embodiment of the present invention. As shown in FIG. 7, a moving-film 102 is stacked on a fixed film 104. The moving-film 102 has a polymer film 701 and an auxiliary electrode 702 disposed on the polymer film 701. A stationary body 101 has a base body 703; a first insulating film 704 covering the base body 703; a holding electrode 705 and scanning electrode 706 disposed on the first insulating film 704; and a second insulating film 707 covering the holding electrode 705 and scanning electrode 706. The holding electrode 705 is formed to expand from a position on the counter face facing the movable end side of the corresponding moving-film 102 in the same pixel (i.e., a moving-film paired with the holding electrode 705) to a position on the backside. The holding electrode 705 is connected to a signal line 206 disposed on a substrate 709 through a conductive connector 708. The scanning electrode 706 is electrically isolated from the holding electrode 705, and disposed at a position closer to the fixed end side of the moving-film 102, than the holding electrode 705 is.

In a method of manufacturing this structure, the base body 703 is first prepared, using plastic molding or metal press-working, such that it has a curved surface that becomes more distant from the corresponding moving-film, at a position of the moving-film closer to the movable end side. Then, the base body 703 is covered with an adhesive sheet used as the first insulating film 704, and a metal film (conductive film) used as the holding electrode 705 and scanning electrode 706 is laminated thereon. Then, a polymer used as the second insulating film 707 is laminated on the holding electrode 705 and scanning electrode 706, using an adhesive sheet. Then, using a laser beam, the metal film (conductive film) is cut and divided into the holding electrode 705 and scanning electrode 706. At this time, the power of the laser beam is adjusted no to cut the base body 703.

In place of the sequential steps described above, the same structure may be formed by one step of bonding a metal-evaporated polymer film to the base body 703, using an adhesive sheet. In this case, the adhesive sheet is used as the first insulating film 704, the evaporated metal as the holding electrode 705 and scanning electrode 706, and the polymer film as the second insulating film 707.

On the other hand, the moving-film 102 is prepared by vapor-depositing aluminum as the auxiliary electrode 702 on the polymer film 701. Then, the fixed end side of the moving-film 102 is bonded to the stationary body 101 with acrylic adhesive. Alternatively, the moving-film 102 may be fixed to the stationary body 101 by placing the moving-film 102 on the stationary body 101 and applying an adhesive tape from above the moving-film 102. Then, the fixed film 104 made of polyethylene terephthalate or the like is bonded to the fixed end side of the moving-film 102, in the same way.

Figure 8:
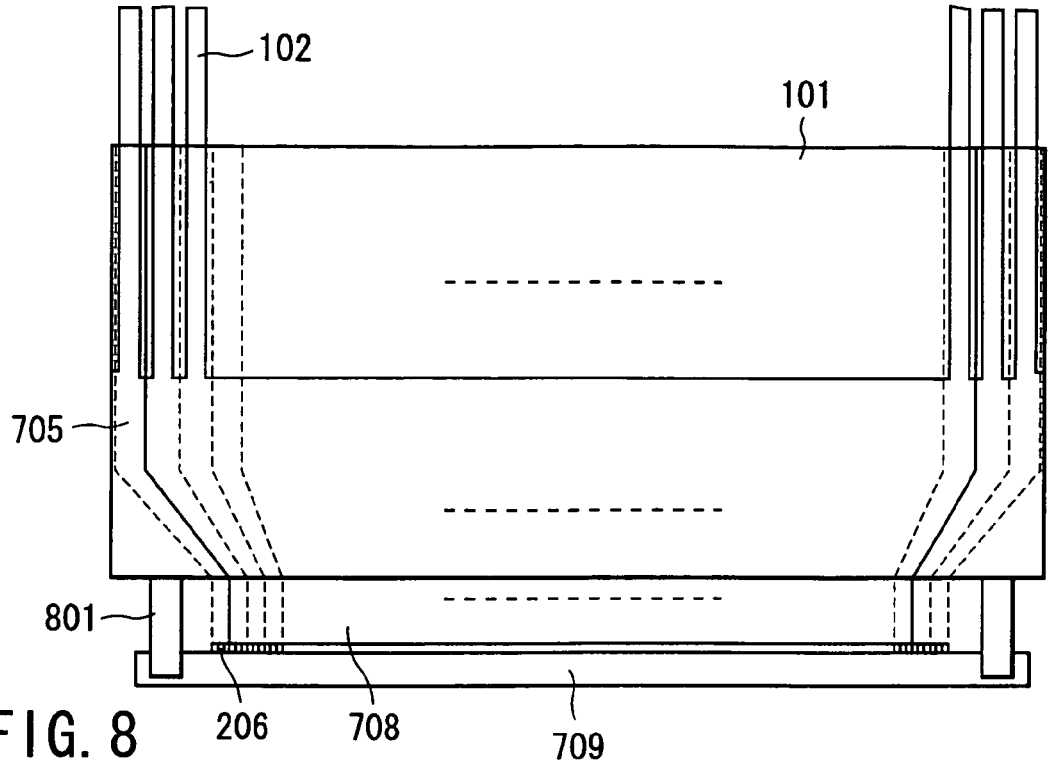
FIG. 8 is a plan view of the structure shown in FIG. 7, from an observing point PV2 in FIG. 7.

Next, an explanation will be given, with reference to FIG. 8, of a method of fixing the stationary body 101, moving-film 102, and fixed film 104 thus integrated onto the substrate 709. Although the display area is observed from an observing point PV1 in FIG. 7, FIG. 8 is a plan view of the structure shown in FIG. 7, from an observing point PV2 in FIG. 7. In FIG. 8 and the corresponding description, the fixed film and electrodes other than the holding electrode 705 are omitted.

As shown in FIG. 8, the stationary body 101 and moving-film 102 for one row are integrated, and the distal end of the moving-film 102 on the movable end side is divided into portions to correspond to holding electrodes 705 for respective pixels. The stationary body 101 and moving-film 102 for one row are supported on their substrate 709 side by piers 801 connected to the substrate 709. The holding electrodes 705 are arrayed with a smaller width and a smaller pitch than that of the pixels near the piers 801 to spare room for the piers 801. The holding electrodes 705 are connected to anisotropic conductive connectors 708. The holding electrodes 705 are connected to signal lines 206 disposed on the substrate 709 through the conductive connectors 708, and connected to signal lines 206 for other rows. The end portions of the moving-film 102 on the movable end side are connected to each other for adjacent pixels. An auxiliary electrode (not shown) disposed on the moving-film for pixels on one row also works as an auxiliary scanning line. A scanning electrode (not shown) disposed on the stationary body 101 for pixels on one row also works as a scanning line.

The piers 801 are inserted into holes formed in the substrate 709 and fixed by, e.g., screws. The conductive connectors 708 have an adhesive face, which are attached to the substrate so that they are electrically connected to wiring lines on the substrate 709. With this arrangement, the stationary body can be readily provided with a structure having holding electrodes and a scanning electrode.

Figure 9:
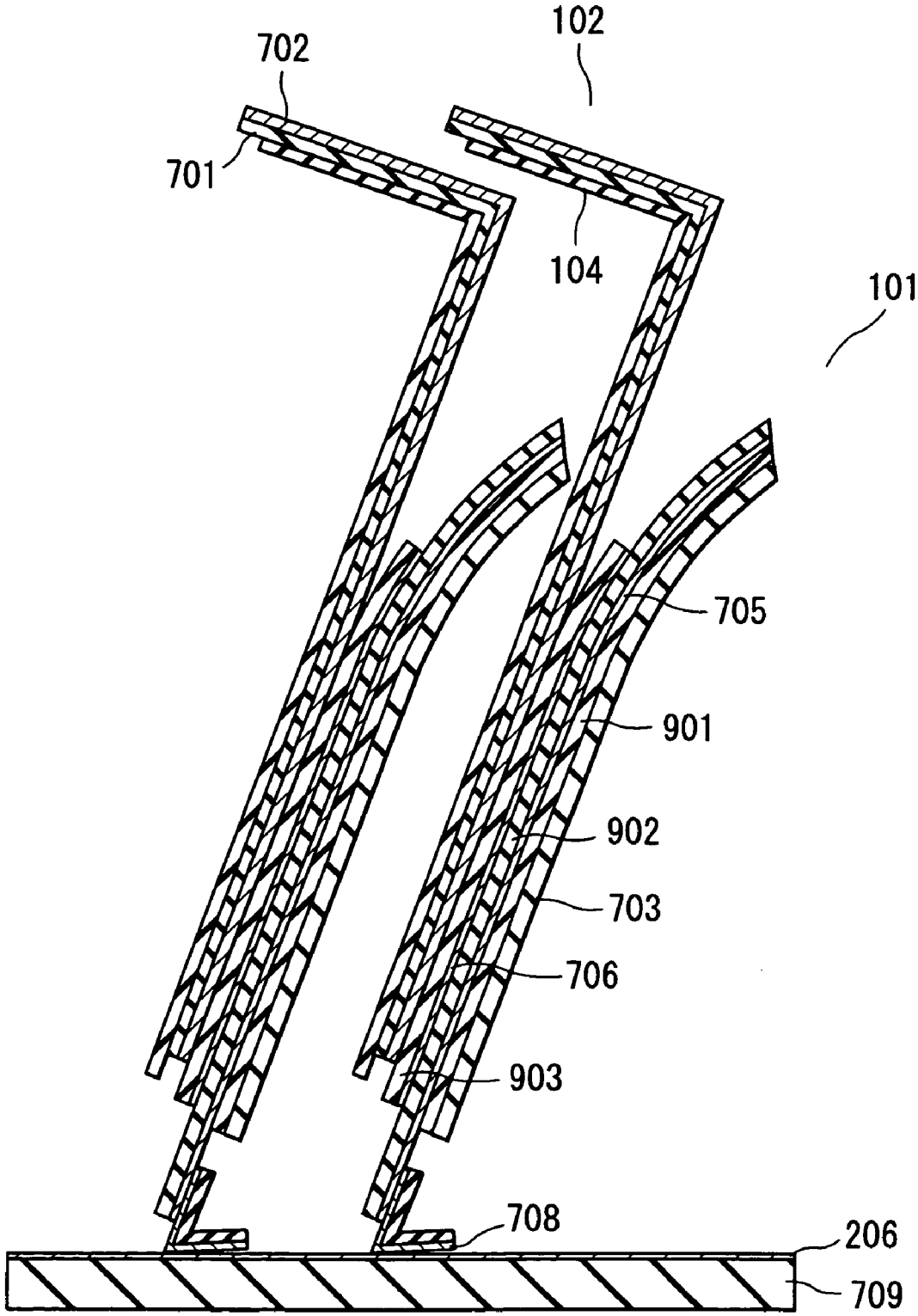
FIG. 9 is a sectional view showing the pixel structure of a moving-film display device according to a first modification of the first embodiment of the present invention.

FIG. 9 is a sectional view showing the pixel structure of a moving-film display device according to a first modification of the first embodiment of the present invention. The structure shown in FIG. 9 includes a stationary body having a shape different from that shown in FIG. 7. According to this structure, holding electrodes are connected to signal lines on a substrate, such that the holding electrode are lead out to the signal lines, not through the backside of a base body, but directly from the front side of the base body. In other words, the lead out portions of the holding electrodes are disposed on the same side as the scanning electrode.

Specifically, as shown in FIG. 9, a base body 703, third insulating film 901, holding electrodes 705, fourth insulating film 902, scanning electrode 706, and fifth insulating film 903 are stacked in this order. The third insulating film 901, holding electrodes 705, and fourth insulating film 902 are disposed almost all over the base body 703. The scanning electrode 706 and fifth insulating film 903 are not disposed on the movable end side. Their material, manufacturing method, and so forth are the same as those of the first embodiment.

Also in the first modification, the stationary body can be readily provided with a structure having holding electrodes and a scanning electrode.

Figure 10:
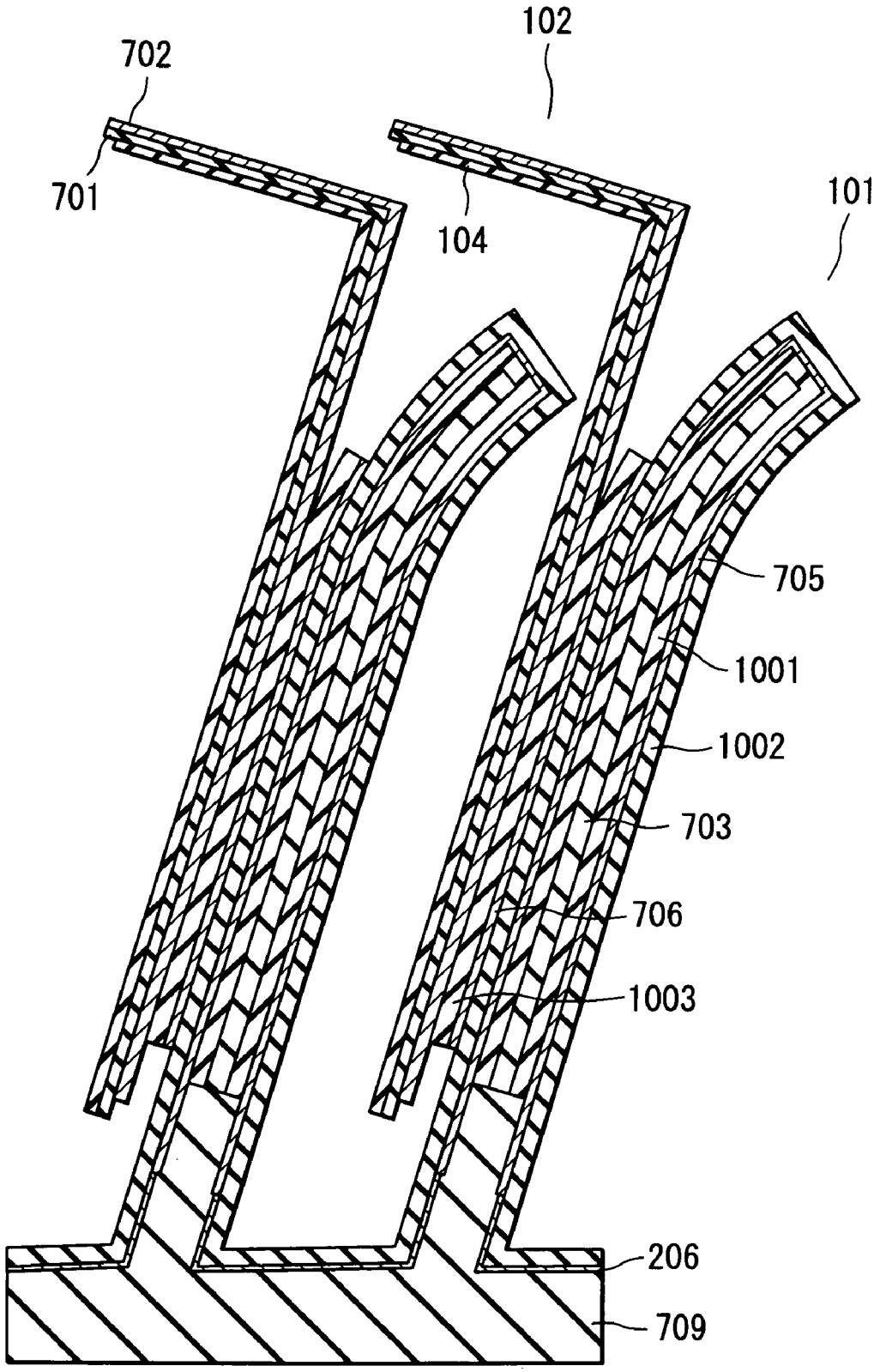
FIG. 10 is a sectional view showing the pixel structure of a moving-film display device according to a second modification of the first embodiment of the present invention.

FIG. 10 is a sectional view showing the pixel structure of a moving-film display device according to a second modification of the first embodiment of the present invention. The structure shown in FIG. 10 includes a stationary body having a shape also different from that shown in FIG. 7. According to this structure, holding electrodes 705 and signal lines 206 are made of the same material, and entirely covered with an insulating film, thereby remarkably simplifying connection assembly of the signal lines.

Specifically, as shown in FIG. 10, a base body 703 is first covered with a sixth insulating film 1001, and then the sixth insulating film 1001 and substrate 709 are covered with a metal film (conductive film) and seventh insulating film 1002. The metal film is used as the holding electrodes 705 and signal lines 206. Then, a scanning electrode 706 and eighth insulating film 1003 are laminated on that counter face of the seventh insulating film 1002, which faces the corresponding moving-film 102. The scanning electrode 706 and eighth insulating film 1003 are not formed on the movable end side.

As a manufacturing method, at first, a PET film is prepared, such that it has a thickness of 5 μm and is provided with vapor-deposited aluminum having a thickness of 30 nm. The PET portion is used for the seventh insulating film 1002 and the aluminum portion is used for the signal lines 206 and holding electrodes 705.

Then, the aluminum portion on the PET film is subjected to patterning by laser or etching, so that lines are formed with the pixel pitch (portions that do not correspond to the pixels may be constricted). The PET film with vapor-deposition aluminum is laminated over the opposite sides of base bodies 703, using adhesive sheets as the sixth insulating film 1001. At this time, the PET film is disposed such that the lines are arrayed in the depth direction perpendicular to the sheet of FIG. 10. As a result, the holding electrodes 705 and signal lines 206 are connected to each other in the lateral direction, and are insulated from each other for each pixel in the depth direction, as shown in FIG. 10.

Then, PET films corresponding to the number of pixels (scanning lines) in the depth direction are laminated, and the operation described above is repeated, so that the holding electrodes 705, signal lines 206, and seventh insulating film 1002 for all the pixels are formed. Then, the scanning electrode 706 and eighth insulating film 1003 are laminated in a manner similar to that previously described.

According to the second modification, the stationary body can be readily provided with a structure having holding electrodes and a scanning electrode, and further provided with signal lines thereon, by a simple method.

In the manufacturing methods described above, the base of the moving-film may be made of a polymer film, such as polyimide, polyethylene terephthalate, polystyrene, polyetherimide, polyamide, or polyethylene naphthalate. The thickness of the polymer film is preferably set to be from about 1 μm to 50 μm. Each of the first to eighth insulating films is suitably made of a material selected in accordance with the manufacturing method, such as an adhesive sheet, polymer or its denatured material, or inorganic material, e.g., alumina, silicon oxide, or silicon nitride. The thickness of each insulating film is preferably set to be from about 1 μm to 50 μm.

The length of the movable portion of the moving-film is preferably set to be from about 0.5 mm to 10 mm. The length of the scanning electrode on the stationary body is preferably set to be from about 0.2 mm to 10 mm. The length of the holding electrode on the stationary body is preferably set to be from about 0.2 mm to 5 mm. Each of the electrodes may be formed by laminating a film-like electrode, or vapor-depositing a metal film.

The conductive connector may be made of an anisotropic conductive gum, anisotropic conductive film, or anisotropic conductive paste. For the base body, a plastic molded product or metal press-working product is suitable. The substrate may be a flexible substrate or ordinary substrate. The moving-film electrode, other electrodes, and insulating films are bonded by, e.g., an adhesive or hot-melt sheet. The structure of the pixels is not limited to those described above. For example, the stationary body may be formed of an injection molded resin product, or made of another material, or formed by another manufacturing method, in a suitable way.

Second Embodiment

Next, an explanation will be given of a second embodiment according to the present invention. According to this embodiment, the positional relationship between the scanning electrode and holding electrode disposed on each stationary body is further controlled, in a structure according to the first embodiment, so that the device can stably operate.

Figure 11:
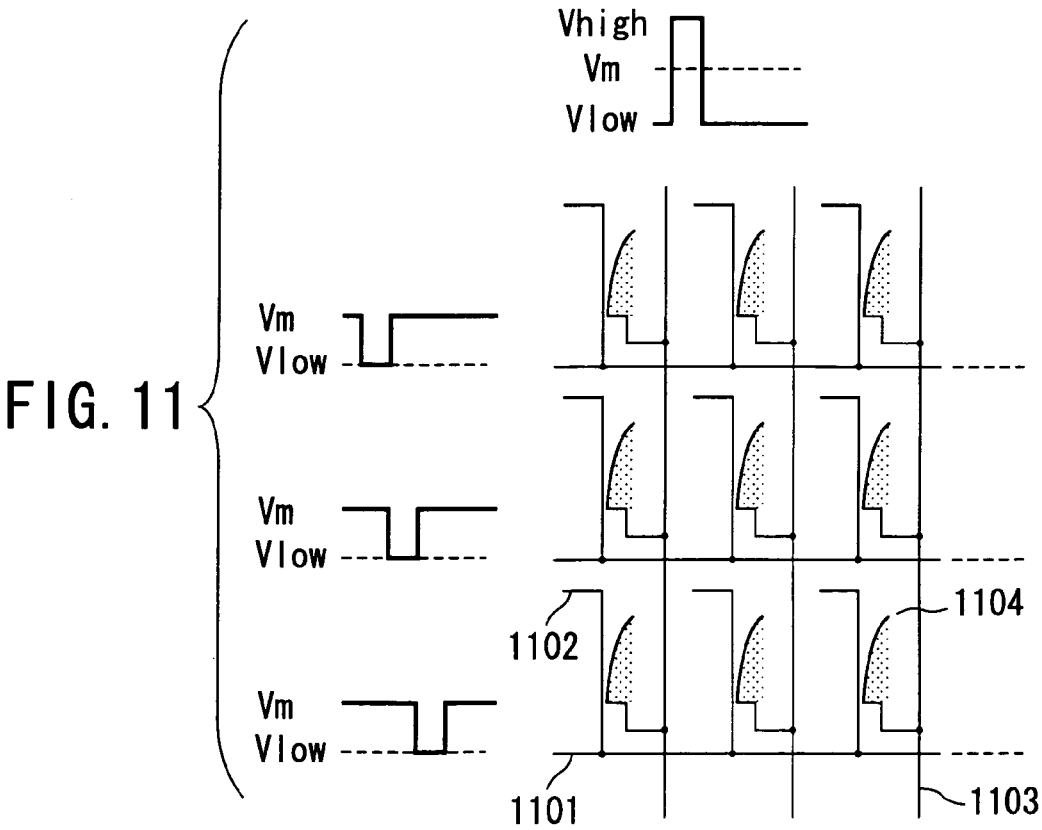
FIG. 11 is a view schematically showing a conventional moving-film display device having pixels arranged in a two-dimensional matrix format, along with signal waves applied thereto.
Figure 12:
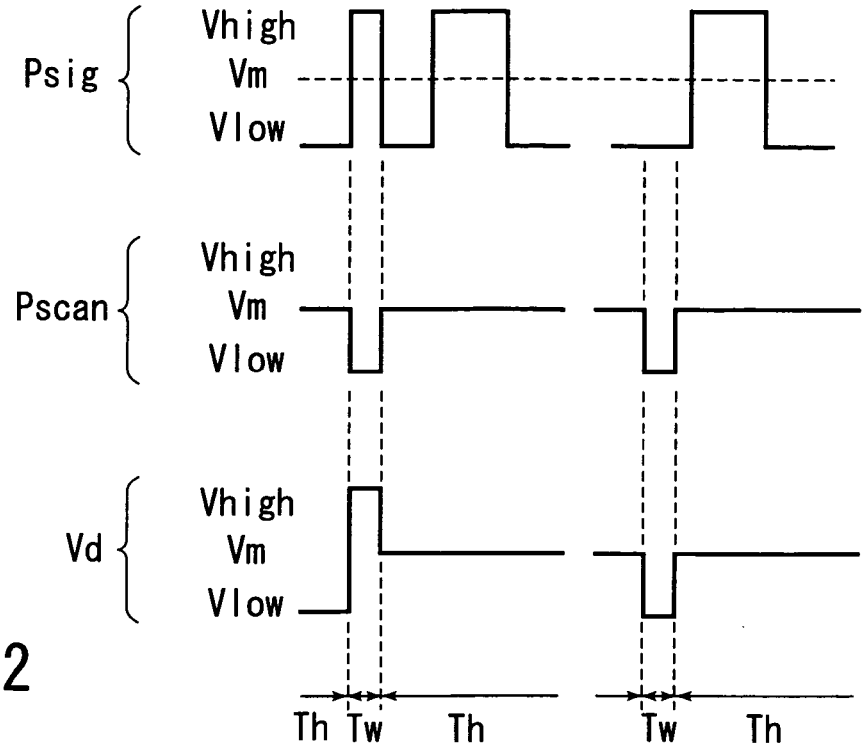
FIG. 12 is a view showing an example of time chart of scanning line potential Pscan and signal line potential Psig in the pixel structure shown in FIG. 11.
Figure 13A:
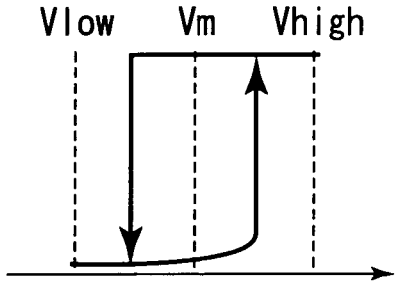
FIGS. 13A to 13C are views showing hysteresis characteristics under an ideal condition, potential-upward-shift condition, and potential-downward-shift condition, respectively, wherein the potential-upward-shift condition and potential-downward-shift condition correspond to malfunctions that may be caused by potential fluctuation.
Figure 13B:
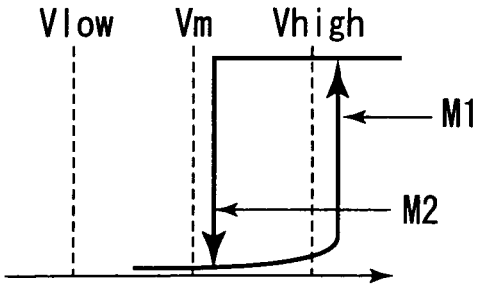
Figure 13C:
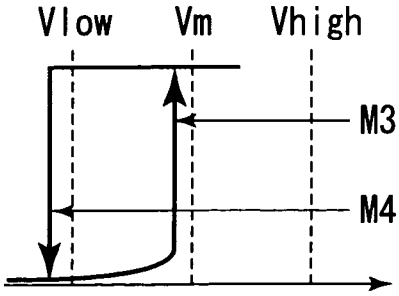

At first, an explanation will be given of conventional structures as to why they cannot stably operate, as the case may be, with reference to FIGS. 11, 12, and 13A to 13C, as well as FIG. 4 described above. FIG. 11 is a view schematically showing a conventional moving-film display device having pixels arranged in a two-dimensional matrix format, along with signal waves applied thereto. FIG. 12 is a view showing an example of time chart of scanning line potential Pscan and signal line potential Psig in the pixel structure shown in FIG. 11. FIGS. 13A to 13C are views showing hysteresis characteristics under an ideal condition, potential-upward-shift condition, and potential-downward-shift condition, respectively, wherein the potential-upward-shift condition and potential-downward-shift condition correspond to malfunctions that may be caused by potential fluctuation.

In FIG. 4, displacement of a moving-film abruptly increases at a threshold voltage of V2, while the displacement of the moving-film abruptly decreases at a threshold voltage of V1. It is defined in the following explanation that a reference value in potential sufficiently lower than V1 is Vlow (or may be 0V), and a reference value in potential sufficiently higher than V2 is Vhigh. A potential between V1 and V2 is defined as Vm. For symmetry in potential, Vm is set to be close to a value of (Vlow+Vhigh)/2.

As shown in FIG. 11, in the conventional moving-film display device, a moving-film electrode 1102 is formed on a moving-film and connected to a scanning line 1101. A stationary body electrode 1104 is formed on a stationary body and connected to the signal line 1103. The potential of the scanning line 1101 is kept at Vm in a retention period Th, and is set at Vlow in a writing period Tw. In general, the writing period shifts from one row to the next sequentially downward one by one, as shown in FIG. 11. On the other hand, the potential of the signal line 1103 takes on Vlow or Vhigh, as shown in FIG. 11, depending on signal states.

As shown in the time chart example of FIG. 12, the writing period Tw starts in a row when the scanning line potential Pscan of the row takes on Vlow. At this time, if the signal line potential Psig of a column takes on Vhigh, the potential difference Vd between the moving-film electrode and stationary body electrode, which is expressed by Vd=Vhigh−Vlow, exceeds V2, whereby the moving-film deflects and the color of the moving-film is displayed. The retention period Th starts in the row when the scanning line potential Pscan of the row takes on Vm. At this time, the potential difference Vd between the electrodes is expressed by Vd=Vm−Vlow, or Vhigh−Vm, in accordance with change in the signal line potential Psig. Since the potential difference Vd between the electrodes is not less than V1, the moving-film does not deflect. Furthermore, when the writing period Tw starts in a row while the scanning line potential Pscan takes on Vlow and the signal line potential Psig also takes on Vlow, the potential difference Vd between the electrodes is 0V. At this time, since the potential difference Vd between the electrodes is not more than V1, the moving-film is set to be the original straight state without reference to the immediately preceding state, and thus the color of the stationary body is displayed.

The conventional moving-film display device described above suffers a problem in that its matrix drive becomes unstable, thereby causing image deterioration. Specifically, due to slight change in assembling conditions, the values of operational potential differences V1 and V2 may vary, depending on electrode pairs of the moving electrode and stationary electrode, and this variation may reach almost Vm. An explanation will be given of malfunctions to possibly occur, with reference to FIGS. 13A to 13C.

FIG. 13A corresponds to a case where the device is assembled under an ideal condition, and FIGS. 13B and 13C correspond to cases where the characteristic shifts on the higher potential side and the lower potential side, respectively.

When the writing period Tw starts in a row while the scanning line potential takes on Vlow, if the signal line potential takes on Vhigh, the moving-film is supposed to deflect. However, in the case shown in FIG. 13B, Vhigh is a potential lower than the threshold voltage that causes the moving-film to deflect, and thus the moving-film can never deflect (malfunction M1). On the other hand, when the writing period Tw starts in a row, if the signal line potential takes on Vlow, the moving-film is supposed to return from deflection. However, in the case shown in FIG. 13C, Vlow is a potential higher than the threshold voltage that causes the moving-film to return from deflection, and thus the moving-film can never solve the deflection (malfunction M4).

When a row is in the retention period while the potential difference between the electrodes is almost Vm, the moving-film is supposed to maintain the given state in either case where it has deflected or non-deflected. However, in the case shown in FIG. 13B, Vm is a potential lower than Vl, and thus the moving-film cannot maintain the deflecting state (malfunction M2). In the case shown in FIG. 13C, Vm is a potential higher than V2, and thus the moving-film undesirably deflects without reference to the give state (malfunction M3).

Furthermore, as is evident from FIG. 4 in which the displacement characteristic shows a slow rising curve in the course of voltage increase, the moving-film set in the non-deflecting state in the writing period slightly deflects in the following retention period. In other words, coupling deflection occurs in the retention period. FIGS. 14A and 14B are views showing hysteresis characteristics under an ideal condition and a non-ideal condition, respectively, in relation to coupling deflection of a moving-film. The curved shape of coupling deflection varies depending on the electrode pairs. As shown in FIG. 14A, under the ideal condition, the coupling deflection Dc is small. Where the rising curve is steep, the coupling deflection Dc may reach an observable level, as shown in FIG. 14B. In the latter case, picture image edge shift, image indistinctness, and the like occur, and furthermore color mixture occurs in color display.

In light of the problems described above, according to the second embodiment, the positional relationship between the scanning electrode and holding electrode disposed on each stationary body is further controlled, in a structure according to the first embodiment, so that the device can stably operate. At first, the positions of the holding electrode and scanning electrode will be defined with reference to FIG. 15. FIG. 15 is a view for explaining a moving-film display device according to the second embodiment of the present invention.

As shown in FIG. 15, an original point OP is set at that point closest to the movable end side within a region where the stationary body 101 is in contact with the moving-film 102. Since the stationary body 101 and moving-film 102 are in contact with each other on the fixed end side, the original point OP is placed at a point where they start separating from each other. A distal end TP is set at that point of the stationary body 101 projected on the non-deflecting moving-film 102, which is closest to the movable end side. In this respect, when a display device is actually fabricated, the moving-film 102 in the non-deflecting state may be disposed not to be perpendicular to the surface of the substrate 709, as shown in FIGS. 7, 9 and 10. Even in such a case, the distal end TP is set at the distal end point of the stationary body 101 projected toward the moving-film 102. A holding electrode end HE is set at the end of the holding electrode 205 on the fixed end side, projected on the non-deflecting moving-film 102. The end of the holding electrode 205 on the fixed end side denotes its scanning electrode side end, in other words. The modified relationship described above between the moving-film 102 and the surface of the substrate 709 can be applied also to the holding electrode end HE. A scanning electrode end SE is set at the end of the scanning electrode 203 on the movable end side, projected on the non-deflecting moving-film 102. The end of the scanning electrode 203 on the movable end side denotes its holding electrode side end, in other words. The modified relationship described above between the moving-film 102 and the surface of the substrate 709 can be applied also to the scanning electrode end SE. A middle point MP is set at a point equidistant from the holding electrode end HE and scanning electrode end SE. L expresses the distance between the original point OP and distal end TP. Lmid expresses the distance between the original point OP and middle point MP. Each of the distances is measured as the shortest distance.

In other words, L described above can be treated as the length of that portion projected on the non-deflecting moving-film 102, which extends from the original point or the substantially proximal end of the scanning electrode 203 on the fixed end side to the substantially distal end of the holding electrode 205 on the movable end side. Lmid described above can be treated as the length of that portion projected on the non-deflecting moving-film 102, which extends from the original point to the substantial boundary between the scanning electrode 203 and holding electrode 205.

According to the definition described above, this embodiment satisfies the following formula (1).

$$0.4 \leqq Lmid/L \leqq 0.8 \quad (1)$$

The formula (1) can be used to determine the position of the gap between the holding electrode 205 and scanning electrode 203 relative to the stationary body 101. Specifically, as the Lmid/L value is smaller in the formula (1), the holding electrode 205 becomes larger, while, as the value is larger, the scanning electrode 203 becomes larger. The formula (1) also shows that determining the relative position of the gap between the holding electrode 205 and scanning electrode 203 is more important than the size of the gap, to ensure the display stability.

During the retention period, a potential difference is formed only between the holding electrode 205 and auxiliary electrode 201 to hold the deflecting state of the moving-film. This condition provides a lager threshold voltage for the moving-film to return from the deflecting state, and thereby making the hysteresis curve smaller. In this case, since the device becomes more sensitive against fluctuations in the operational potential, the positions of the holding electrode 205 and scanning electrode 203 need to be controlled. The size of the gap between the holding electrode 205 and scanning electrode 203 is preferably set smaller, e.g., at about 100 μm or less, to effectively use electrostatic attraction.

For example, as described above, where the holding electrode 205 and scanning electrode 203 are formed by cutting a common conductive film, such as a metal film, the gap between the holding electrode 205 and scanning electrode 203 can be sized only to electrically separate the holding electrode 205 and scanning electrode 203 from each other. In this case, the formula (1) can be construed such that L essentially denotes the total projected effective length of the holding electrodes 205 and scanning electrode 203 projected on the non-deflecting moving-film (cantilever), and Lmid essentially denotes the projected effective length of the scanning electrode 203 projected on the non-deflecting moving-film.

Next, a more detailed explanation will be given of the second embodiment, while showing present examples of the second embodiment, reference examples, and a comparative example.

PRESENT EXAMPLE 1

A moving-film display device having a structure shown in FIG. 7 was formed. First, a base body 703 was formed by press-working a stainless steel plate. The base body 703 was formed to have a curved surface. The length of the base body 703 was set at 5 mm.

Then, the base body 703 was covered with an adhesive sheet used as a first insulating film 704, and a metal film of aluminum used as a holding electrode 705 and scanning electrode 706, both laminated thereon. The holding electrode 705 and scanning electrode 706 were then provided with a second insulating film 707 of polyethylene terephthalate laminated thereon.

On the other hand, a moving-film 102 was prepared, using a polymer film 701 of polyethylene terephthalate provided with an auxiliary electrode 702 formed by vapor-depositing aluminum thereon. The fixed end side of the moving-film 102 was then bonded to a stationary body 101 by acrylic adhesive. A fixed film 104 of polyethylene terephthalate or the like was then bonded to the moving-film 102. Then, a moving-film display device was fabricated, using the steps described in the first embodiment.

The distal end, original point, holding electrode end, scanning electrode end, and middle point of the resultant structure were measured in accordance with the definition described above. The value of Lmid/L calculated on the basis of the measurement was 0.8.

In the display device of this present example, as described in the first embodiment, the holding electrodes 705 was connected to a signal line (not shown), the scanning electrode 706 was connected to a scanning line (not shown), and the auxiliary electrode 702 was connected to an auxiliary scanning line (not shown). The signal line (Sig.), auxiliary scanning line (Canti.), and scanning line (Add.) were respectively supplied with voltage waveforms, as shown in FIG. 5. The potentials of them were set as follows:

The holding electrode (Sig.) was supplied with a higher potential of 85V and a lower potential of 42.5V.

The scanning electrode (Add.) was supplied with a higher potential of 85V and a lower potential of 0V.

The auxiliary electrode (Canti.) was supplied with a higher potential of 85V and a lower potential of 0V.

As a result, it was possible to display a clear picture image having no defects.

PRESENT EXAMPLE 2

A moving-film display device was fabricated, using the same conditions as the present example 1, except that the lengths of the holding electrode 705 and scanning electrode 706 and the gap therebetween were adjusted to set the value of Lmid/L at 0.7.

Then, voltage waveforms shown in FIG. 5 with potentials shown in FIG. 5 were applied.

As a result, it was possible to display a clear picture image having no defects.

PRESENT EXAMPLE 3

A moving-film display device was fabricated, using the same conditions as the present example 1, except that the lengths of the holding electrode 705 and scanning electrode 706 and the gap therebetween were adjusted to set the value of Lmid/L at 0.6.

Then, voltage waveforms shown in FIG. 5 with potentials shown in FIG. 5 were applied.

As a result, it was possible to display a clear picture image having no defects.

PRESENT EXAMPLE 4

A moving-film display device was fabricated, using the same conditions as the present example 1, except that the lengths of the holding electrode 705 and scanning electrode 706 and the gap therebetween were adjusted to set the value of Lmid/L at 0.4.

Then, voltage waveforms shown in FIG. 5 were applied, using potentials as follows:

The holding electrode (Sig.) was supplied with a higher potential of 70V and a lower potential of 35V.

The scanning electrode (Add.) was supplied with a higher potential of 70V and a lower potential of 0V.

The auxiliary electrode (Canti.) was supplied with a higher potential of 70V and a lower potential of 0V.

As a result, it was possible to display a clear picture image having no defects, while reducing the drive voltage level as a whole.

REFERENCE EXAMPLE 1

A moving-film display device was fabricated, using the same conditions as the present example 1, except that the lengths of the holding electrode 705 and scanning electrode 706 and the gap therebetween were adjusted to set the value of Lmid/L at 0.9.

Then, voltage waveforms shown in FIG. 5 with potentials described in the present example 1 were applied.

As a result, although, in a small number of pixels, a moving-film, which was supposed to keep deflecting, returned from the deflecting state during a retention period, it was possible to perform a normal display.

REFERENCE EXAMPLE 2

A moving-film display device was fabricated, using the same conditions as the present example 1, except that the lengths of the holding electrode 705 and scanning electrode 706 and the gap therebetween were adjusted to set the value of Lmid/L at 0.3.

Then, voltage waveforms shown in FIG. 5 with potentials described in the present example 4 were applied.

As a result, although, in a small number of pixels, a moving-film, which was supposed not to deflect, vibrated during a retention period, it was possible to perform a normal display.

COMPARATIVE EXAMPLE 1

A moving-film display device having a pixel structure shown in FIG. 11 was fabricated in accordance with a conventional method. Then, voltage waveforms shown in FIG. 12 were applied, using potentials as follows:

The signal line potentials were set at Vhigh of 120V and Vlow of 0V.

The scanning line potentials were set at Vm of 60V and Vlow of 0V.

As a result, in a large number of pixels, a moving-film, which was supposed to keep deflecting, returned from the deflecting state during a retention period. Furthermore, in a large number of pixels, a moving-film, which was supposed not to deflect, vibrated during a retention period. Accordingly, it was not possible to perform a normal display.

As described with reference to the present examples 1 to 4, reference examples 1 and 2, and comparative example 1, it has been found that the holding electrode disposed on the movable end side of the stationary body allows a picture image to be stably displayed. In addition, it has been found that controlling the positions of the holding electrode and scanning electrode allows a picture image to be more stably displayed.

Third Embodiment

Next, an explanation will be given of a third embodiment of the present invention. According to this embodiment, a structure according to the first embodiment is modified such that the counter face of the stationary body facing the corresponding moving-film is formed to have a flat surface disposed on the movable end side and a curved surface following the flat surface, so that the device can stably operate.

FIG. 16 is a view for explaining a moving-film display device according to a third embodiment of the present invention. FIG. 16 schematically shows a moving-film 102 and stationary body 101. In this embodiment, the stationary body 101 differs from that of the first embodiment, and has a shape formed of a linear portion 1601 (flat surface) on the movable end side of the moving-film 102, and a curved portion 1602 (curved surface) following the linear portion 1601. A second linear portion 1603 is disposed on the fixed end side, following the curved portion 1602, although it may be omitted.

Next, an explanation will be give of the reason as to why a moving-film display device according to this embodiment can stably operate. FIGS. 17A and 17B are views showing the relationship of distal end displacement St of a moving-film relative to applied voltage V between the moving-film and stationary body, to explain a hysteresis characteristic according to the third embodiment.

In general, the counter face of the stationary body facing the corresponding moving-film has a curved surface. The curved surface is shaped such that the surface of the stationary body separates from the moving-film in a curve toward the movable end side of the moving-film. A combination of the stationary body and moving-film having such a shape shows a hysteresis characteristic shown in FIG. 4 or 17A.

According to this embodiment, the stationary body 101 has the first linear portion 1601 on the distal end side. This structure reduces strain energy to be accumulated in the moving-film 102 when the moving-film 102 deflects, as compared to the conventional structure, and provides a hysteresis curve shown in FIG. 17B. This lowers the threshold voltage for the moving-film 102 to return from a deflecting state to a non-deflecting state, thereby expanding the width W of the hysteresis curve. As a consequence, even if the vale of operational potential difference fluctuates among pixels and thus they have slightly different characteristics, it is possible to stably perform simple matrix drive.

For example, a moving-film display device according to this embodiment is fabricated, as follows. As shown in FIG. 7, the base body 703 of a stationary body 101 made of stainless steel is prepared, and a first insulating film 704 made of polyethylene terephthalate film and having a thickness of 4.5 μm is laminated thereon. Then, a holding electrode 705 and scanning electrode 706 are formed on the first insulating film 704, using aluminum, and a second insulating film 707 made of polyethylene terephthalate film and having a thickness of 4.5 μm is further formed thereon. By doing so, the stationary body 101 is arranged such that the maximum gap of the stationary electrode is 0.44 mm, the length of the first linear portion 1601 is 3 mm, and the length of the curved portion is 2 mm, as shown in FIG. 16. In this case, the second linear portion is not formed.

Then, a moving-film 102 is prepared such that a polymer film 701 is made of polyethylene terephthalate having a length of 6 mm, a width of 0.5 mm, and a thickness of 16 μm, and an auxiliary electrode 702 is made of aluminum having a thickness of 30 nm. Then the moving-film display device is fabricated, in the same way as the first embodiment.

A present example of the moving-film display device was fabricated, using the conditions described above. As a result, the moving-film 102 completely deflected at a potential difference of 70 to 90V between the stationary electrode 101 and moving electrode 102, and then returned to the original state at a potential difference of 5 to 20V. On the other hand, where the stationary body 101 was not provided with the linear portion, but only with a curved shape, the moving-film 102 returned to the original state at a voltage of 20 to 40V.

Accordingly, where the stationary body is provided with a shape according to this embodiment, the hysteresis curve is expanded, thereby performing more stable display.

As described above, according to the first to third embodiments, it is possible to provide a moving-film display device and driving method thereof with high image quality.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A moving-film display device comprising:

a moving-film having a fixed end and a movable end;

a stationary body having a counter face that is shaped more distant from the moving-film as a position of the counter face shifts from the fixed end side to the movable end side;

a colored portion disposed at the movable end of the moving-film;

an auxiliary electrode disposed on the moving-film between the fixed end and the movable end, a scanning electrode disposed on the counter face to face the auxiliary electrode on the fixed end side;

a holding electrode disposed on the counter face to face the auxiliary electrode on the movable end side;

a signal line electrically connected to the holding electrode to supply an image signal; and a drive section configured to control voltages to be supplied to the auxiliary electrode, the scanning electrode, and the holding electrode.

2. The device according to claim 1, wherein the auxiliary electrode is electrically connected to an auxiliary scanning line, the scanning electrode is electrically connected to a scanning line, the auxiliary scanning line and the scanning line are disposed in parallel with each other, and the auxiliary scanning line and the scanning line intersect the signal line.

3. A driving method of the device according to claim 2, wherein the device has a scanning line first potential and a scanning line second potential higher than the scanning line first potential as potentials of the scanning line, an auxiliary scanning line first potential and an auxiliary scanning line second potential higher than the auxiliary scanning line first potential as potentials of the scanning line, and a signal line first potential and a signal line second potential higher than the signal line first potential as potentials of signal scanning line, and the method comprises:

a writing first period in which the scanning line is supplied with the scanning line second potential, the auxiliary scanning line is supplied with the auxiliary scanning line first potential, and the signal line is supplied with the signal line second potential, to cause the moving-film to deflect toward the stationary body;

a writing second period in which the scanning line is supplied with the scanning line second potential, the auxiliary scanning line is supplied with the auxiliary scanning line second potential, and the signal line is supplied with the signal line first potential to cause the moving-film to maintain a deflecting state toward the stationary body, or the signal line is supplied with the signal line second potential to cause the moving-film to separate from the stationary body, in accordance with image information; and a retention period in which the scanning line is supplied with the scanning line first potential, and the auxiliary scanning line is supplied with the auxiliary scanning line first potential to maintain a state given in the writing second period.

4. The method according to claim 3, wherein the scanning line second potential, the auxiliary scanning line second potential, and the signal line second potential are equal to each other.

5. The device according to claim 1, wherein a first potential difference is formed between the scanning electrode and the auxiliary electrode to cause the moving-film to deflect, and a second potential difference is formed, after the first potential difference disappears, between the auxiliary electrode and the holding electrode to cause the moving-film to maintain a deflecting state.

6. The device according to claim 1, wherein a formula of $0.4 \leqq Lmid/L \leqq 0.8$ is satisfied, where L and Lmid are respective lengths of first and second portions projected on the moving-film in a non-deflecting state, wherein the first portion extends from an original point that is a substantially proximal end of the scanning electrode on the fixed end side, to a substantially distal end of the holding electrode on the movable end side, and the second portion extends from the original point to a substantial boundary between the scanning electrode and the holding electrode.

7. The device according to claim 1, wherein the counter face of the stationary body has a flat surface disposed on the movable end side and a curved surface following the flat surface.

8. The device according to claim 1, wherein the moving-film comprises a plurality of films corresponding to a plurality of colors, and the colored portion comprises a plurality of transparent portions with different colors disposed at movable ends of the plurality of films.

9. The device according to claim 1, wherein holding electrodes of a plurality of pixels that share a common signal line are formed along with the common signal line from a continuous metal film.

10. A driving method of the device according to claim 1, comprising:

a writing first period in which a first potential difference is formed between the auxiliary electrode and the scanning electrode to cause the moving-film to deflect;

a writing second period in which the first potential difference is removed between the auxiliary electrode and the scanning electrode, while the holding electrode is supplied with a potential by the image signal, that determines the moving-film to maintain a deflecting state or not; and a retention period in which a state is maintained where the first potential difference is not formed between the auxiliary electrode and the scanning electrode, and a potential difference formed between the auxiliary electrode and the holding electrode falls in a range that holds a state given in the writing second period.

11. A moving-film display device having a display area formed of a pixel matrix, which is defined by rows and columns of pixels, the device comprising:

a cantilever disposed in each pixel and having a fixed end and a free end to be movable by deflection, such that displayed color of each pixel is determined by an exposed state of the free end relative to the display area in accordance with deflection of the cantilever;

a first electrode disposed on the cantilever between the fixed end and the free end;

a second electrode disposed stationary to face the first electrode on the fixed end side;

a third electrode disposed stationary to face the first electrode on the free end side, distance between the first and third electrodes being larger than distance between the first and second electrodes;

a plurality of first scanning lines extending in the pixel matrix and each being configured to supply the first electrode with a first scanning signal for selecting each pixel;

a plurality of second scanning lines extending in the pixel matrix and each being configured to supply the second electrode with a second scanning signal for selecting each pixel;

a plurality of signal lines extending in the pixel matrix and each being configured to supply the third electrode with an image signal for determining displayed color of each pixel; and a drive and control section configured to selectively supply the first and second scanning lines and the signal lines with the first and second scanning signals and the image signal, respectively.

12. The device according to claim 11, wherein the signal lines extend along one of the rows and the columns of the pixel matrix, and the first and second scanning lines extend in parallel with each other and across the signal lines.

13. The device according to claim 11, further comprising a stationary body disposed to face the cantilever and having a counter face shaped substantially along a deflect curve of the cantilever, wherein the second and third electrodes are disposed on the counter face of the stationary body.

14. The device according to claim 13, wherein the second and third electrodes are formed by cutting a common conductive film disposed on the counter face to satisfy a formula of $0.4 \leqq Lmid/L \leqq 0.8$, where L essentially denotes a total projected effective length of the second and third electrodes projected on the cantilever in a non-deflecting state, and Lmid essentially denotes a projected effective length of the second electrode projected on the cantilever in the non-deflecting state.

15. The device according to claim 13, wherein the counter face comprises a curved portion disposed on the fixed end side and provided with the second electrode, and a linear portion disposed on the free end side and provided with the third electrode.

16. The device according to claim 11, wherein the cantilever disposed in each pixel comprises a plurality of films corresponding to a plurality of colors, and a plurality of transparent portions with different colors are disposed at free ends of the plurality of films.

17. The device according to claim 11, wherein third electrodes of a plurality of pixels that share a common signal line are formed along with the common signal line from a continuous conductive film.

18. The device according to claim 11, wherein the drive and control section performs:

a writing first period for each pixel in which a first potential difference is formed between the first and second electrodes by the first and second scanning signals to cause the cantilever to deflect;

a writing second period for each pixel in which the first potential difference is removed between the first and second electrode by the first and second scanning signals, while the third electrode is supplied with a potential by the image signal, that determines the cantilever to maintain a deflecting state or not; and a retention period for each pixel in which a state is maintained where the first potential difference is not formed between the first and second electrodes, and a potential difference formed between the first and third electrodes falls in a range that holds a state given in the writing second period.

19. The device according to claim 18, wherein, in the writing second period, the image signal forms a second potential difference, smaller than the first potential difference, between the first and third electrodes to maintain a deflecting state of the cantilever, or forms a third potential difference, smaller than the second potential difference, between the first and third electrodes not to maintain a deflecting state of the cantilever.

20. The device according to claim 19, wherein both of the first and second scanning signals maintain a first value potential in the retention period; one of the first and second scanning signals takes on the first value potential in the writing first period and a second value potential in the writing second period; the other of the first and second scanning signals takes on the second value potential in the writing first and second periods; and the image signal takes on a third value potential between the first and second value potentials to maintain a deflecting state of the cantilever, or takes on a value that is closer to the second value potential than the third value potential is, so as not to maintain a deflecting state of the cantilever, in the writing second period.

* * * * *